US009555987B2

(12) United States Patent
Kurokawa

(10) Patent No.: US 9,555,987 B2
(45) Date of Patent: Jan. 31, 2017

(54) SHEET CONVEYER AND IMAGE READING APPARATUS

(71) Applicant: Brother Kogyo Kabushiki Kaisha, Nagoya-shi, Aichi-ken (JP)

(72) Inventor: Kotaro Kurokawa, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/054,787

(22) Filed: Feb. 26, 2016

(65) Prior Publication Data

US 2016/0251175 A1 Sep. 1, 2016

(30) Foreign Application Priority Data

Feb. 27, 2015 (JP) ..... 2015-038850

(51) Int. Cl.
*B65H 3/06* (2006.01)
*B65H 5/06* (2006.01)
*B65H 3/54* (2006.01)

(52) U.S. Cl.
CPC ..... *B65H 3/0684* (2013.01); *B65H 3/54* (2013.01); *B65H 5/062* (2013.01); *B65H 2404/1521* (2013.01)

(58) Field of Classification Search
CPC .. B65H 3/0684; B65H 3/54; B65H 2404/1521
See application file for complete search history.

(56) References Cited

U.S. PATENT DOCUMENTS 4,901,117 A 2/1990 Derrick
6,307,621 B1 10/2001 Endo et al.
7,980,549 B2 7/2011 Hamaguchi
9,242,817 B2 1/2016 Suganuma
2007/0063420 A1 3/2007 Seike et al.
2008/0012201 A1 1/2008 Nakashima et al.
2008/0309008 A1 12/2008 Hamaguchi
2012/0133095 A1 5/2012 Tu
(Continued)

FOREIGN PATENT DOCUMENTS

JP 2008-308257 12/2008

OTHER PUBLICATIONS

May 20, 2015—(US) Non-Final Office Action—U.S. Appl. No. 14/582,598.
Oct. 7, 2015—(US) Notice of Allowance—U.S. Appl. No. 14/582,598.

*Primary Examiner* — Luis A Gonzalez
(74) *Attorney, Agent, or Firm* — Banner & Witcoff, Ltd.

(57) ABSTRACT

A sheet conveyer including a sheet support, a pickup roller, a separator roller, a holder, a guide, an urging member, and a contact section is provided. The holder is swingable and supports the pickup roller rotatably. The guide is attached to the holder and movable to swing relatively to the holder along with a swing movement of the holder. Urging force from the urging member acts on the guide to move toward a first position with respect to the holder. The contact section contacts a contacting part in the guide to restrict, the contacting part from being moved along with the swing movement of the holder. The guide is movable relatively to the holder from a position closer to the first position toward a position closer to a second position against the urging force from the urging member and allows the holder to further move toward the uppermost position.

14 Claims, 10 Drawing Sheets

(56) References Cited

U.S. PATENT DOCUMENTS

| | | | | |
|---|---|---|---|---|
| 2013/0193632 | A1* | 8/2013 | Hida | B65H 3/0684 271/10.11 |
| 2014/0079460 | A1 | 3/2014 | Kanaya | |
| 2014/0138904 | A1 | 5/2014 | Arimura | |
| 2015/0183598 | A1* | 7/2015 | Suganuma | B65H 3/0684 358/498 |
| 2015/0183601 | A1 | 7/2015 | Suganuma | |
| 2015/0239691 | A1* | 8/2015 | Ito | B65H 3/0684 271/109 |
| 2015/0239693 | A1* | 8/2015 | Kurokawa | B65H 3/5223 271/3.23 |
| 2015/0274455 | A1* | 10/2015 | Ito | B65H 3/52 271/109 |

* cited by examiner

SHEET CONVEYER AND IMAGE READING APPARATUS

CROSS-REFERENCE TO RELATED APPLICATION

This application claims priority under 35 U.S.C. §119 from Japanese Patent Application No. 2015-038850, filed on Feb. 27, 2015, The entire subject matter of the application is incorporated herein by reference.

BACKGROUND

Technical Field

The following disclosure relates to a sheet conveyer and an image reading apparatus.

Related Art

A sheet conveyer having a pickup roller, to pick up sheets from a sheet support section and convey the sheets downstream in a conveying direction, and a separator roller, to separate the sheets conveyed by the pickup roller one by one and convey the sheets further downstream in the conveying direction, is known.

The pickup roller may be rotatably supported by a holder. The holder may be supported to be swingable about an axis which is coincident with a support shaft being a rotation center of the separator roller. The pickup roller may swing together with the holder, and thereby a gap between the pickup roller and the sheet support section may be adjusted.

SUMMARY

In the above described configuration, when the sheets are set on the sheet support section, the sheets may contact a contact part of the holder and may be guided to a lower side of the holder. At this time, an uppermost position of the sheets may move upward depending on thickness of the sheets or a quantity of the sheets, and the holder may be moved to swing such that an upstream end of the holder, in the conveying direction, moves away from the sheet support section. As a result, the pickup roller may be placed in a condition to contact the uppermost position of the sheets.

However, the holder configured as described above may move such that the upstream end of the holder is moved farther from the sheet support section as the quantity of sheets set on the sheet support section increases, or as the thickness of each sheet increases even when the quantity of the sheets is the same. Therefore, in order to achieve a configuration, in which the holder is allowed to be sufficiently moved away from the sheet support section, a large space needs to be reserved in an area opposite from the sheet support section across the holder. When such a large space is reserved, a size of the neighboring area around the holder may increase accordingly, and an entire size and/or height of the sheet conveyer may be prevented from downsizing.

Meanwhile, the pickup roller may press the sheets against e sheet support section at a certain amount of pressure by own weight of the pickup roller that swings together with the holder. However, when the quantity of the sheets to be set on the sheet support section increases, the pressure to be applied to the sheets by the pickup roller may be reduced. Therefore, when curled sheets are set on the sheet support section, and if the pressure from the pickup roller is insufficient to the sheets, the insufficient pressure may not straighten the curl. As a result, the pickup roller may rotate idly without feeding the sheets.

Therefore, the weight at the part of the pickup roller that swings together with the holder may be increased so that an amount of the pressure to be applied to the sheets from the pickup roller may be increased. However, if the pressure is simply increased, the pressure may be excessive to a smaller number of sheets, and the sheets may be wrinkled by the excessive pressure.

The present disclosure s advantageous in that a sheet conveyer aid an image reading apparatus, which may be downsized and in which idle rotation of a pickup roller and wrinkling by the pickup roller may be restrained, are provided.

According to an aspect of the present disclosure, a sheet conveyer is provided. The sheet conveyer includes a sheet support configured to support a sheet; a pickup roller configured to convey the sheet supported by the sheet support downstream in a conveying direction; a separator roller configured to separate the sheet conveyed by the pickup roller to convey one by one further downstream in the conveying direction; a holder configured to support the pickup roller rotatably, the holder being configured to be swingable about an axis extending in parallel with a rotation axis of the pickup roller to move between a lowermost position, in which a gap between the pickup roller and the sheet support is smallest, and an uppermost position, in which the gap is largest; a guide configured to be attached to the holder and movable to swing relatively to the holder about a swing axis in accordance with a swing movement of the holder between a first position and a second position with respect to the holder, the guide including a guide surface arranged on an upstream side of the holder in the conveying direction, the guide being configured guide a leading end of the sheet set on the sheet support to the gap between the pickup roller and the sheet support along the guide surface; an urging member arranged between the holder and the guide, the urging member being configured to apply urging force that acts on the guide to move toward the first position with respect to the holder; and a contact section configured to contact a contacting part in the guide, when the holder swings to move from a position closer to the lowermost position toward a position closer to the uppermost position, and restrict the contacting part from being moved along with the swing movement of the holder. When the holder swingably moved toward the uppermost position is at a position where the contact section restricts the contacting part from moving, the guide is movable relatively to the holder from a position closer to the first position toward a position closer to the second position against the urging force from the urging member and allows the holder to further move toward the uppermost position.

According to another aspect of the present disclosure, an image reading apparatus including a sheet support configured to support a sheet; a conveyer configured to pick up the sheet from the sheet support and convey the sheet along a conveyer path in a conveying direction; and a reader unit configured to read images of the sheet being conveyed by the conveyer, is provided. The conveyer includes a pickup roller configured to convey the sheet supported by the sheet support downstream in the conveying direction; a separator roller configured to separate the sheet conveyed by the pickup roller to convey one by one further downstream in the conveying direction; a holder configured to support the pickup roller rotatably, the holder being configured to be swingable about an axis extending in parallel with a rotation axis of the pickup roller to move between a lowermost position, in which a gap between the pickup roller and the sheet support is smallest, and an uppermost position, in which the gap is largest; a guide configured to be attached to the holder and movable to swing relatively to the holder about a swing axis in accordance with a swing movement of the holder between a first position and a second position with respect to the holder, the guide including a guide surface arranged on an upstream side of the holder in the conveying direction, the guide being configured guide a leading end of the sheet set on the sheet support to the gap between the pickup roller and the sheet support along the guide surface; an urging member arranged between the holder and the guide, the urging member being configured to apply urging force that acts on the guide to move toward the first position with respect to the holder; and a contact section configured to contact a contacting part in the guide, when the holder swings to move from a position closer to the lowermost position toward a position closer to the uppermost position, and restrict the contacting part from being moved along with the swing movement of the holder. When the holder swingably moved toward the uppermost position is at a position where the contact section restricts the contacting part from moving, the guide is movable relatively to the holder from a position closer to the first position toward a position closer to the second position against the urging force from the urging member and allows the holder to further move toward the uppermost position.

BRIEF DESCRIPTION OF THE ACCOMPANYING DRAWINGS

Figure 3A:
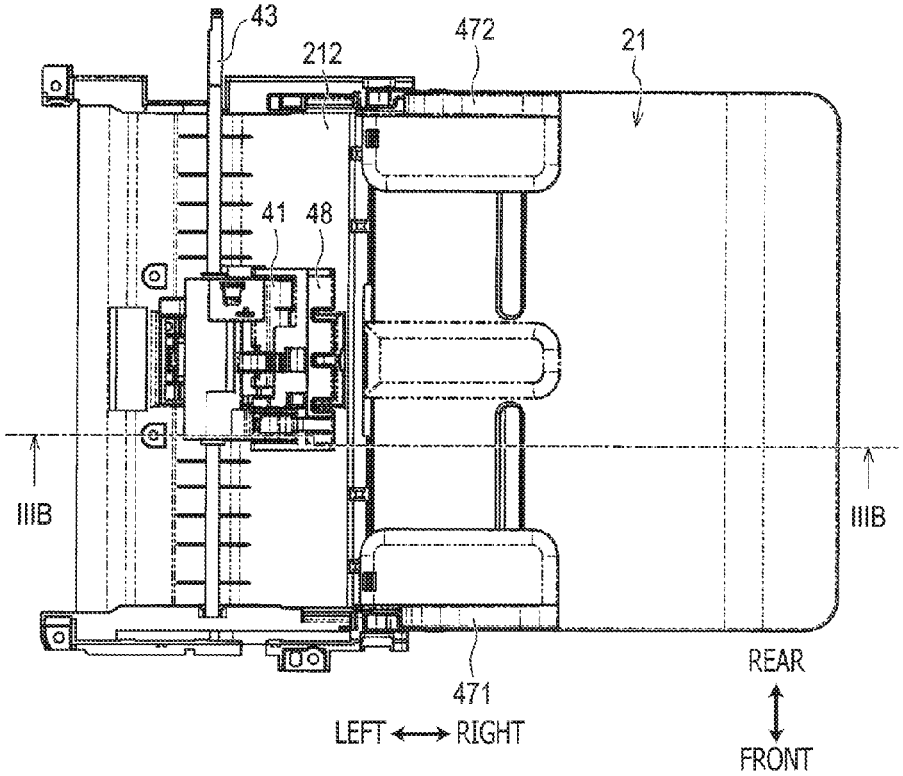
FIG. 3A is a plan view to illustrate a structure in an area in the vicinity of a supply unit and a holder in the MFP according to the embodiment of the present disclosure.
Figure 3B:
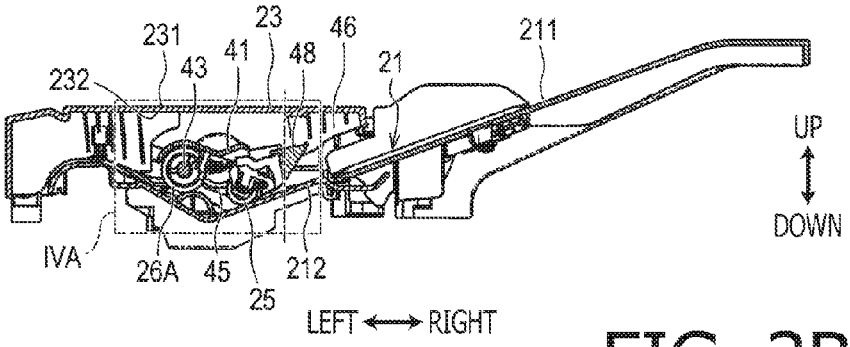
FIG. 3B is a cross-sectional view of the area in the vicinity of the supply unit and the holder taken along a line IIIB-IIIB in FIG. 3A.
Figure 4A:
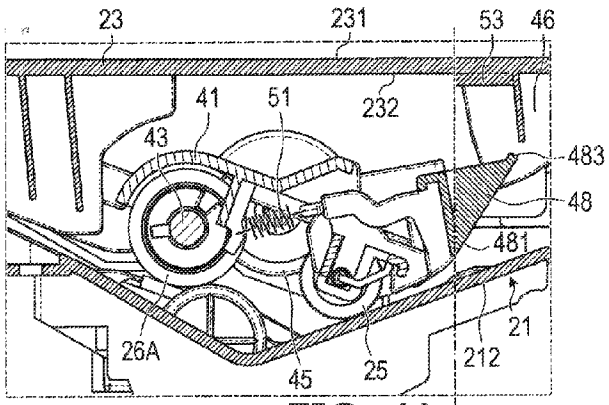
Figure 4B:
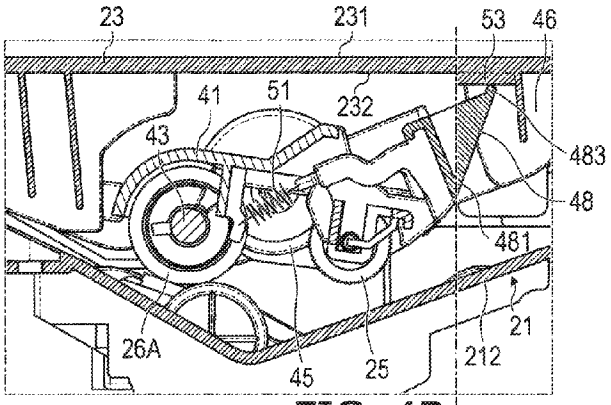
Figure 4C:
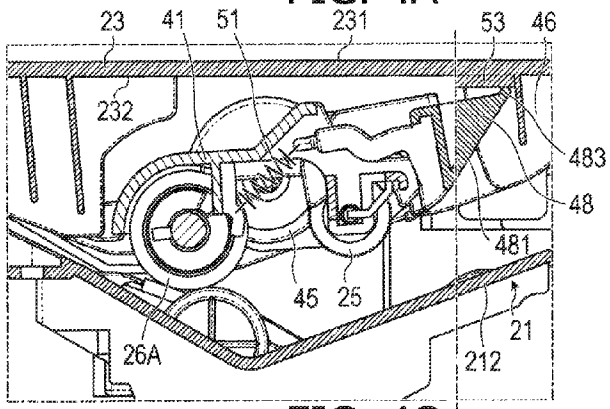
Figure 4D:
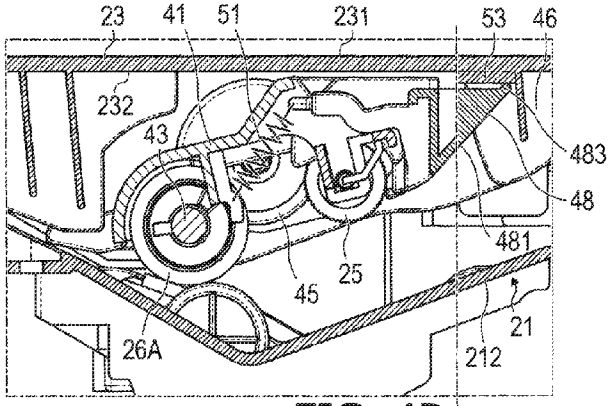

FIG. 4A is an enlarged view of an area IVA shown in FIG. 3B with the holder at a lowermost position in the MFP according to the embodiment of the present disclosure. FIG. 4B is an enlarged view of the area IVA with an upstream end portion of a guide contacting a contact section in the MFP according to the embodiment of the present disclosure. FIG. 4C is an enlarged view of the area IVA with the holder at a position closer to an uppermost position in the MFP according to the embodiment of the present disclosure. FIG. 4D is an enlarged view of the area IVA with the holder at the uppermost position in the MFP according to the embodiment of the present disclosure.

Figure 5:
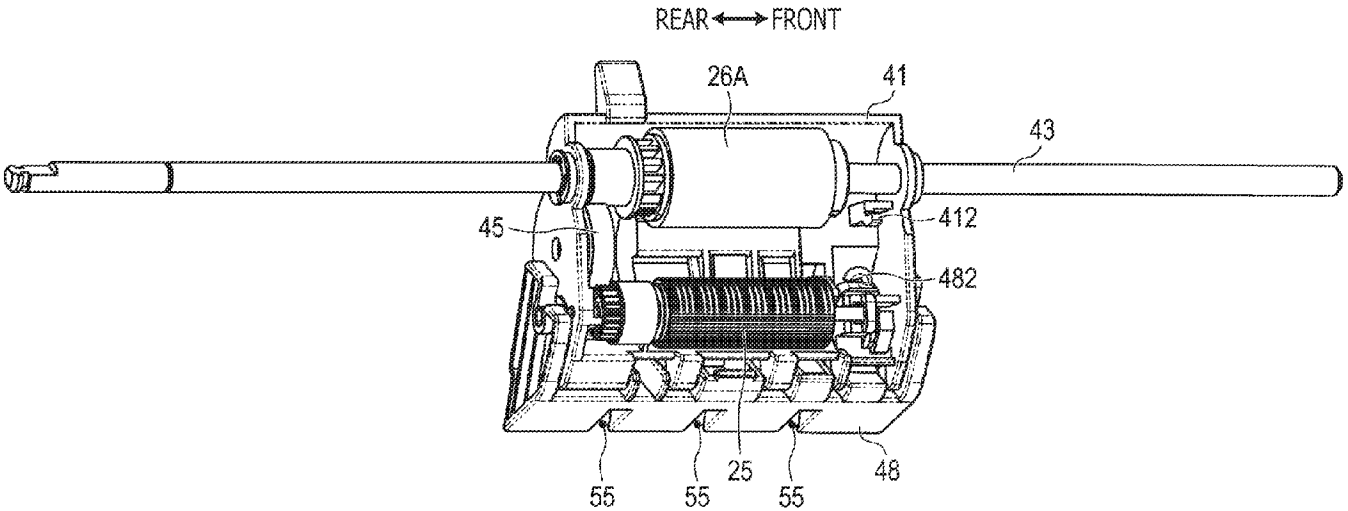

FIG. 5 is a perspective upward view of the holder and the guide in the MFP according to the embodiment of the present disclosure.

Figure 6:
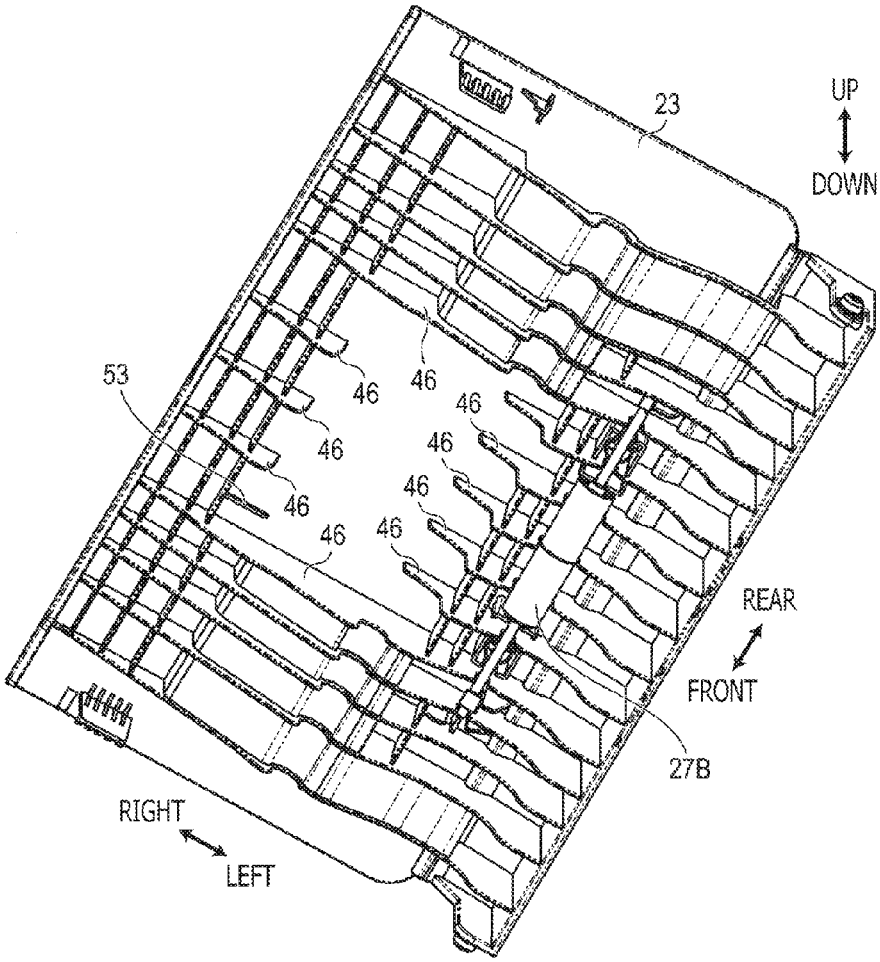

FIG. 6 is a perspective upward view of a cover in the MFP according to the embodiment of the present disclosure.

Figure 7:
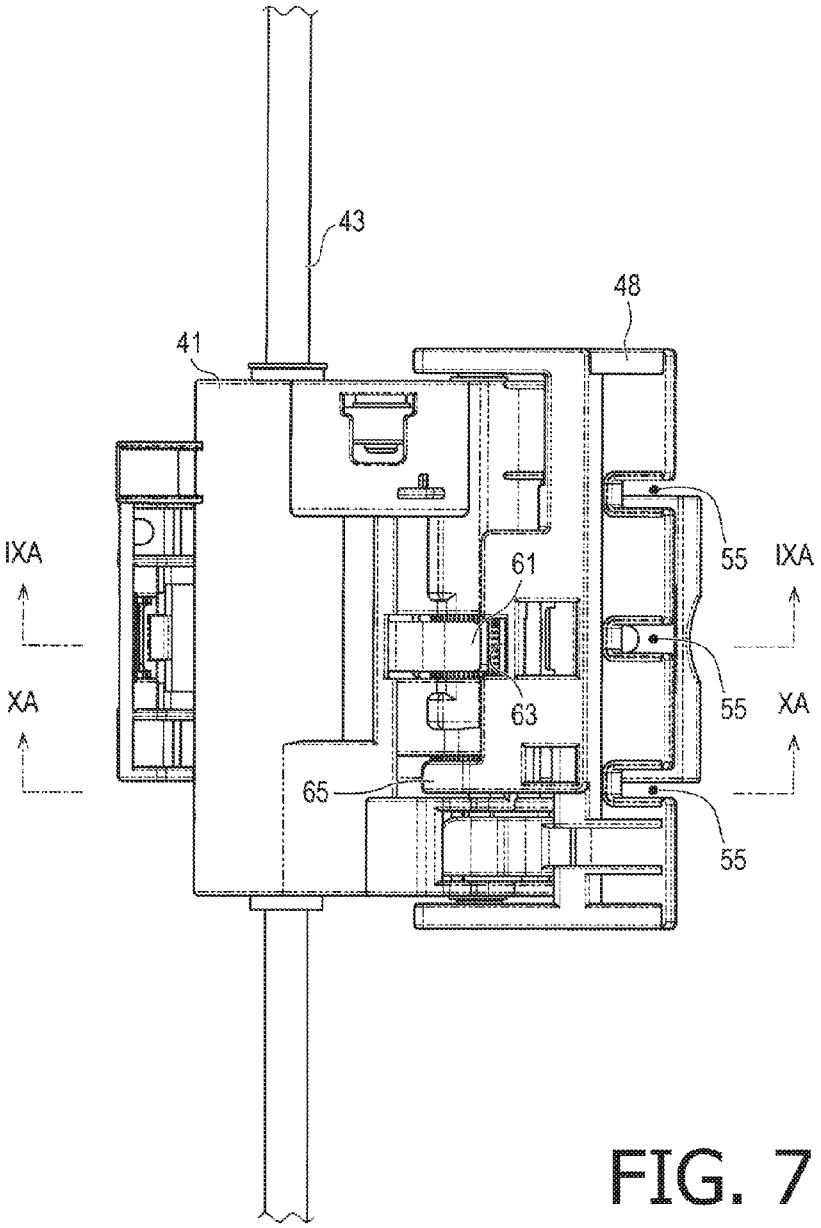

FIG. 7 is a plan view of the ho r and the guide in the MFP according to the embodiment of the present disclosure.

Figure 8A:
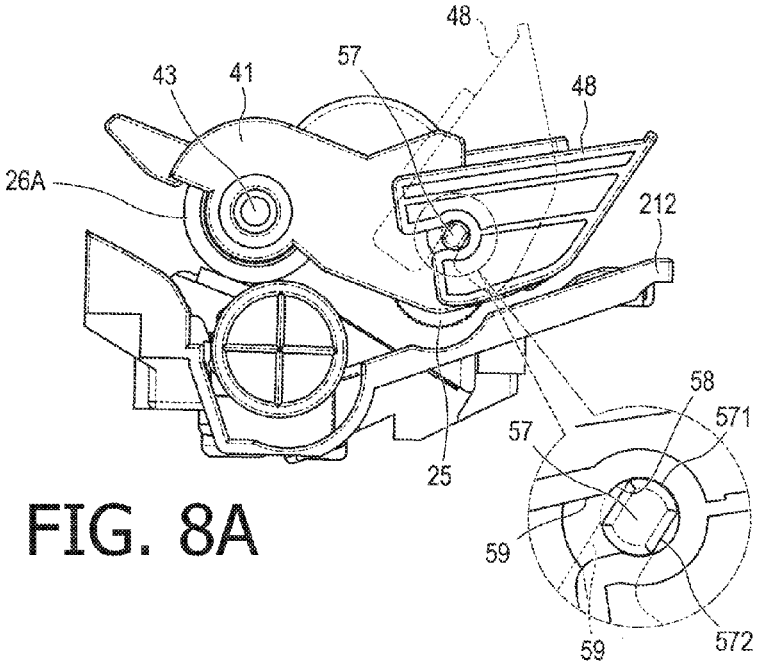
Figure 8B:
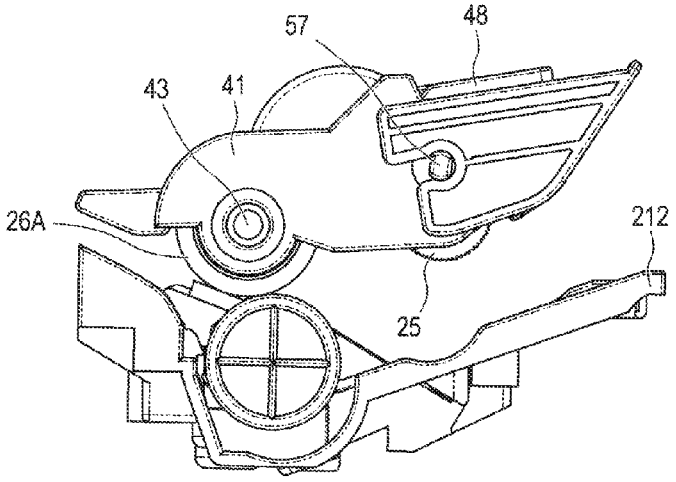

FIG. 8A is a front view of the holder in the lowermost position and the guide in a first position in the MFP according to the embodiment of the present disclosure. FIG. 8B is a front view of the holder in the uppermost position and the guide in a second position in the MFP according to the embodiment of the present disclosure.

Figure 9A:
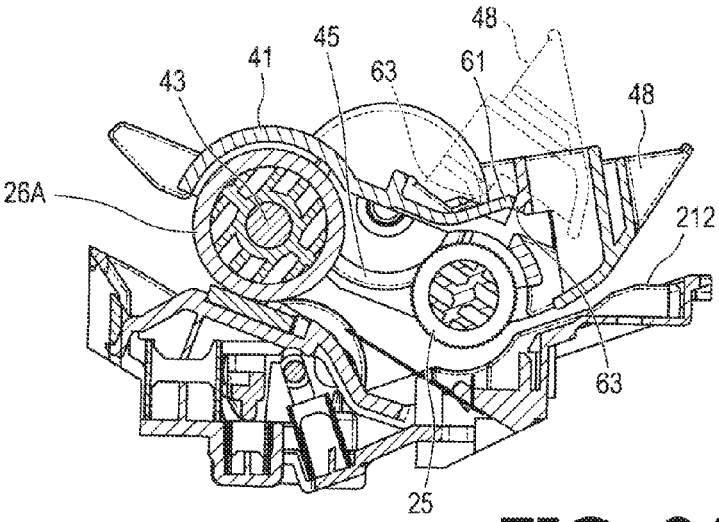
Figure 9B:
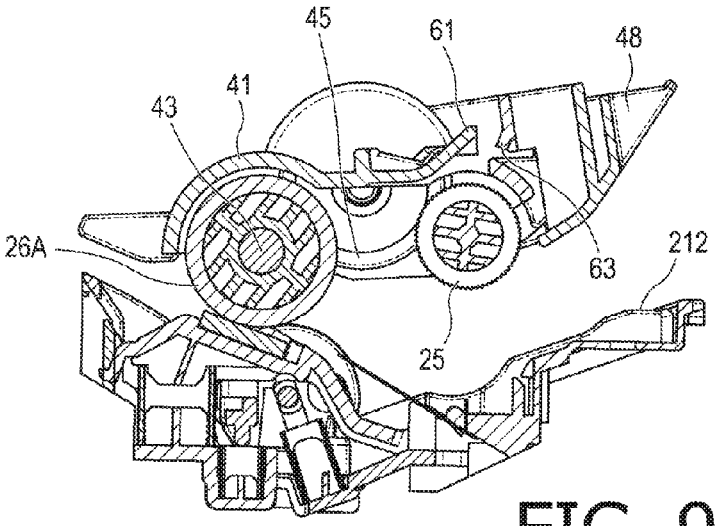

FIG. 9A is a cross-sectional view of the holder in the lowermost position and the guide in the first position taken at a line IXA-IXA shown in FIG. 7. FIG. 9B is a cross-sectional view of the holder in the uppermost position and the guide in the second position taken at the line IXA-IXA shown in FIG. 7.

Figure 10A:
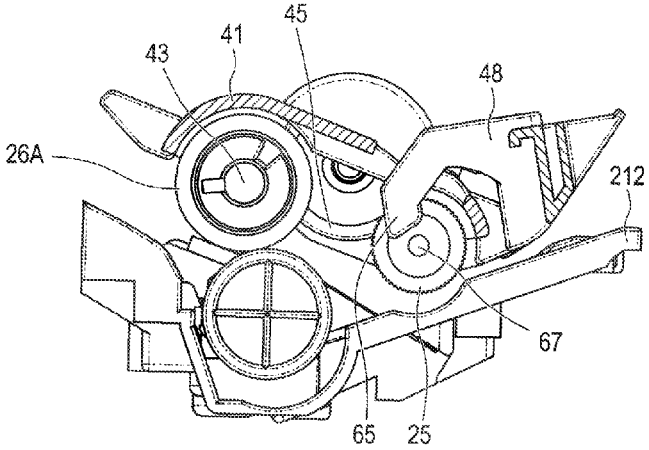
Figure 10B:
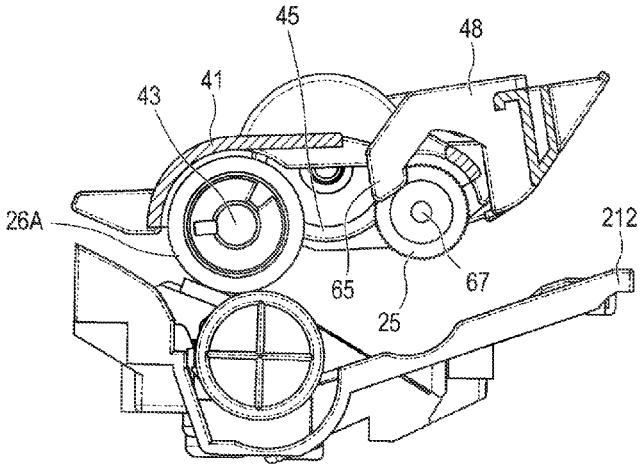

FIG. 10A is a cross-sectional view of the holder in the lowermost position and the guide in the first position taken at a line XA-XA shown in FIG. 7. FIG. 10B is a cross-sectional view of the holder in the uppermost position and the guide in the second position taken at the line XA-XA shown in FIG. 7.

DETAILED DESCRIPTION

Hereafter, a sheet conveyer and an image reading apparatus according to an embodiment will be described with reference to the accompanying drawings.

[Configuration of Multifunction Peripheral]

Figure 1:
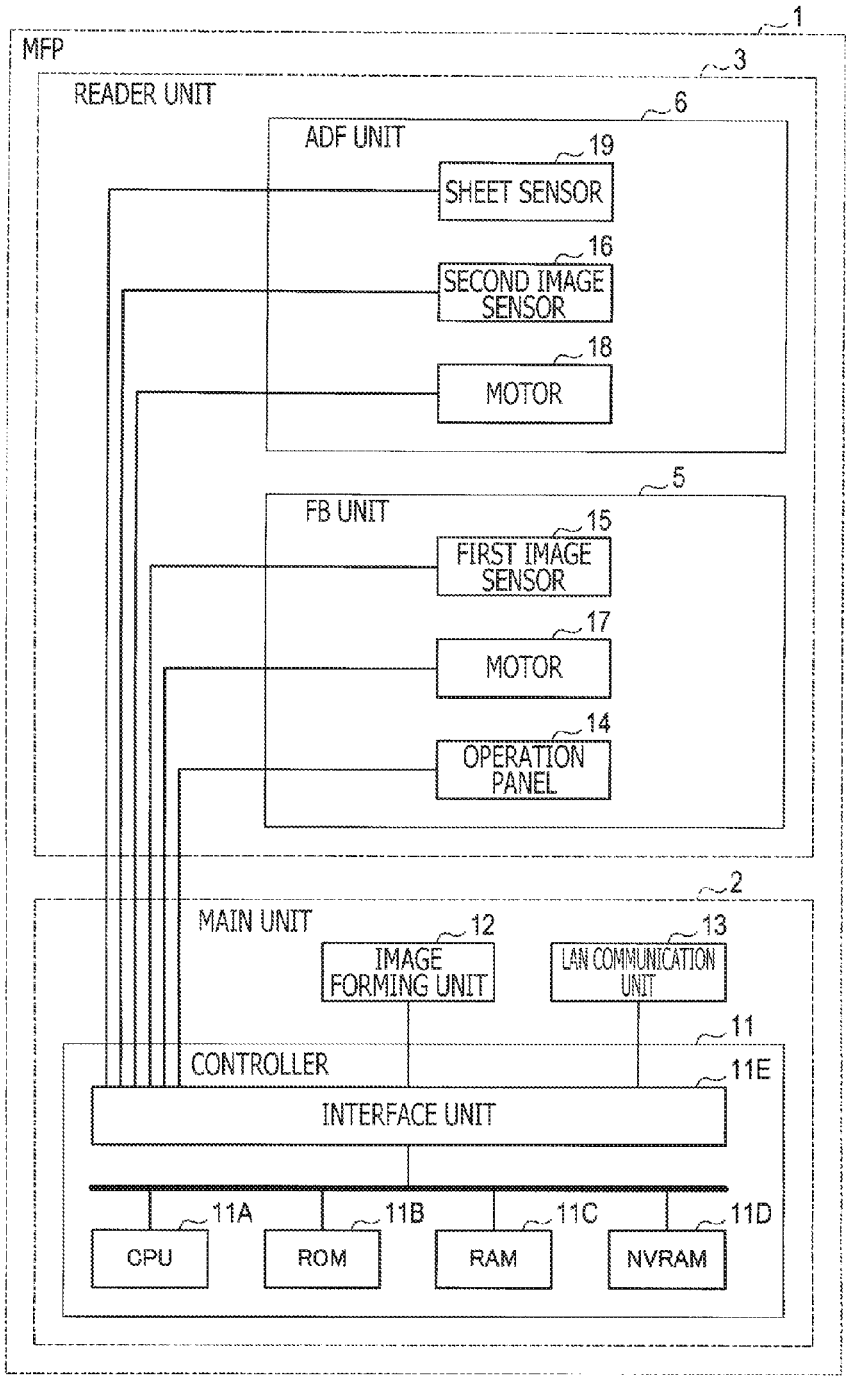
FIG. 1 is a block diagram to illustrate electrical configuration of a multifunction peripheral (MFP) according to an embodiment of the present disclosure.

A multifunction peripheral (MFP) 1 shown in FIG. 1 is provided with the sheet conveyer and the image reading apparatus according to the embodiment. The MFP 1 includes a main unit 2 and a reader unit 3. The reader unit 3 includes a flatbed (FB) unit 5 and an auto-document feeder (ADF) unit 6.

The main unit 2 includes a controller 11. The controller 11 may include a known central processing unit (CPU) 11A, a read-only memory (ROM) 11B, a random-access memory (RAM) 11C, a non-volatile RAM (NVRAM) 11D, and an interface unit 11E. The CPU 11A may execute predetermined processes according to controlling programs, which may be stored in the ROM 11B and the RAM 11C, in order to control behaviors of each part and component in the MFP 1.

The controller 11 may control behaviors of an image forming unit 12, a LAN communication unit 13, an operation panel 14, a first image sensor 15, a second image sensor 16, motors 17, 18, and a sheet sensor 19. Among these, the image forming unit 12, the LAN communication unit 13, and the operation panel 14 are arranged in the main unit 2. Meanwhile, the first image sensor 15 and the motor 17 are arranged in the FB unit 5. The second image sensor 16, the motor 18, and the sheet sensor 19 are arranged in the ADF unit 6.

The image forming unit 12 may form an image on a recordable medium in an inkjet method. For example, the image forming unit 12 may include a conveyer mechanism to convey the recordable medium, a recording head to discharge ink at the recordable medium, and a driving mechanism to move the recording head in reciprocation. The inkjet image forming method for the image forming unit 12 is known; therefore, detailed description will be herein omitted. In the meantime, however, the image forming unit 12 may not necessarily be an inkjet image forming unit but may be an electro-photographic image forming unit.

The LAN communication unit 13 may include a communication interface device supporting wireless LAN and a communication interface device supporting wired LAN. The operation panel 14 may include an input device, which may be operated by a user to input instructions to the MFP 1, and an output device, which may indicate information concerning the behaviors of the MFP 1 to the user. The input device may include a touch-sensitive panel, buttons, and switches. The output device may include a liquid crystal display and indication lamps.

The first image sensor 15 and the second image sensor 16 may be contact image sensors (CISs). The motor 17 is a driving source to activate the first image sensor. The motor 18 is a driving source to convey a sheet in the ADF unit 6. The sheet sensor 19 is a sensor to detect a leading end and a trailing end of the sheet passing through a predetermined detective position in the ADF unit 6.

[Detailed Configuration of the Reader Unit]

Figure 2:
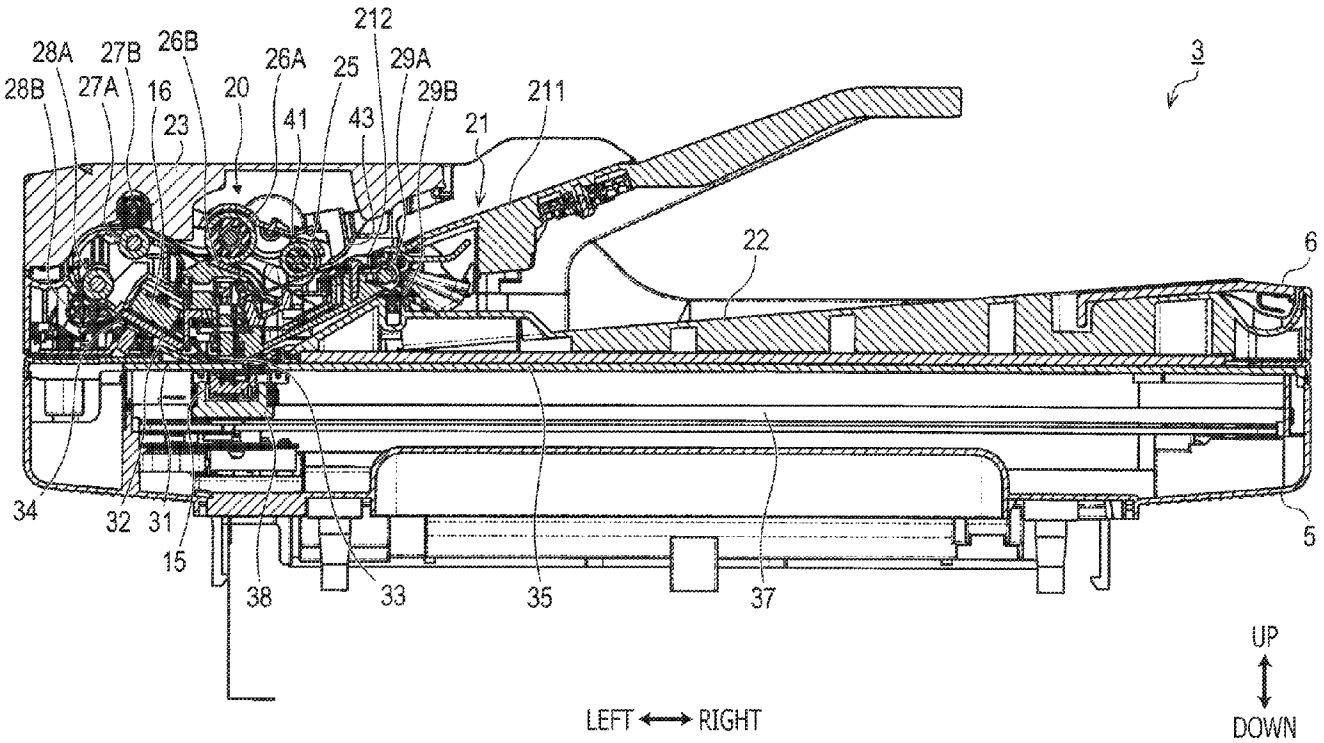
FIG. 2 is a vertical cross-sectional view of a reader unit in the MFP according the embodiment of the present disclosure.

In the reader unit 3, as shown in FIGS. 2 and 3A-3B, the ADF unit 6 includes a conveyer 20 to convey the sheet along a predetermined conveyer path. In an upstream position from the conveyer 20 along a conveying direction to convey the sheet, arranged is a supply unit 21 to support the sheet to be fed to the conveyer 20. In a downstream position from the conveyer 20 along the conveying direction, arranged is a discharge unit 22 to support the sheet being discharged from the conveyer 20.

The conveyer 20 includes a pickup roller 25, a separator roller 26A, a separator piece 26B, a first conveyer roller 27A a first pinch roller 27B, a second conveyer roller 28A, a second pinch roller 28B, an ejection roller 29A, and an ejection pinch roller 29B. In an upper position with respect to the conveyer 20, arranged is a cover 23 to cover the conveyer 20.

The sheets placed on the supply unit 21 are conveyed by the pickup roller 25 downstream along the conveying direction from the supply unit 21 and separated from each other by the separator roller 26A and the separator piece 26B. The separated sheets are conveyed one-by-one by the first conveyer roller 27A and the second conveyer roller 28A further downstream and discharged outside by the ejection roller 29A to be placed on the discharge unit 22.

At a lowest position in the conveyer path, arranged is a first ADF platen 31, and a first sheet presser 33 is arranged in a position to face the first ADF platen 31 across the conveyer path. The first sheet presser 33 faces downward to face with the first ADF platen 31 from above. At a position along the conveyer path, and in an upper position with respect to a part of the conveyer path extending obliquely downward from the second conveyer roller 28A toward the first ADF platen 31, arranged is a second ADF platen 32, and a second sheet presser 34 is arranged in a position to face the second ADF platen 32 across the conveyer path. The second sheet presser 34 faces diagonally upward to face with the second ADF platen 32 from a diagonal lower position. The first ADF platen 31 and the second ADF platen 32 each may be a glass plate.

The FB unit 5 includes a FB platen 35, which may be a glass plate. The FB unit 5 further includes a guide rail 37 and a carriage 38. The guide rail 37 is arranged to longitudinally extend in parallel with lower surfaces of the first ADF platen 31 and the FB platen 35 in an area below the first ADF platen 31 and the FB platen 35. The guide rail 37 may longitudinally extend along a crosswise direction, which is a right-left direction in FIG. 2.

The carriage 38 is supported on the guide rail 37 and is movable in the crosswise direction to reciprocate on the guide rail 37. The carriage 38 is coupled to a teethed belt (not shown) and is movable in the crosswise direction as the teethed belt is circulated by driving force transmitted from the motor 17.

The first image sensor 15 is mounted on the carriage 38 and is moved along with the carriage 38 in the crosswise direction. The second image sensor 16 is arranged in a position to face the second ADF platen 32 across the conveyer path and is immovable therefrom. Reader elements in each of the first sensor 15 and the second image sensor 16 are arranged to align along a direction of depth, which may be a front-rear direction (see FIG. 3A).

When the MFP 1 reads an image of a reading object (e.g., a sheet, pages in a book, etc.) placed on an upper surface of the FB platen 35, the first image sensor 15 is moved along with the carriage 38 in a direction orthogonal to the aligning direction of the image reader elements. The aligning direction of the reader elements may be referred to as a main scanning direction, and the movable direction for the first image sensor 15 to move may be referred to as a sub-scanning direction. When the MFP 1 reads an image on the sheet being conveyed by the conveyer 20, the first image sensor 15 stays in the position below the first sheet presser 33 and the first ADF platen 31 to read the image on the sheet as the sheet contacts the upper surface of the first ADF platen 31 and is conveyed over the first image sensor 15. Meanwhile, the second image sensor 16 at the lower position with respect to the second sheet presser 34 and the second ADF platen 32 reads the image on the sheet as the sheet contacts the lower surface of the second ADF platen 32 and is conveyed over the second image sensor 16.

[Detailed Configuration of Holder and Guide]

In the conveyer 20, as shown in FIG. 2, the pickup roller 25 is attached to a holder 41 rotatably. In other words, the holder 41 rotatably supports the pickup roller 25. The holder 41 is attached to a rotation shaft 43 and is swingable about the rotation shaft 43 (see FIG. 3A).

The rotation shaft 43 is rotated by the driving force transmitted from the motor 18. The separator roller 26A is attached on the rotation shaft 43. Therefore, the rotation shaft 43 and the separator roller 26A are rotatable coaxially. A rotation axis of the pickup roller 25 and the rotation axis of the separator roller 26A extend in parallel with each other. In a position between the rotation shaft 43 and the pickup roller 25, arranged is a driving force transmission 45 to transmit the driving force from the rotation shaft 43 to the pickup roller 25.

The supply unit 21 includes, as shown in FIGS. 3A-3B, a tray 211 and a chute 212. The holder 41 is arranged in an upper position with respect to the chute 212. In an upper position with respect to the holder 41, arranged is the cover 23. The cover 23 includes a first surface 231, which is an upper surface and may form a part of an exterior covering of the MFP 1. On a second surface 232, which is a lower surface of the cover 23, formed are a plurality of ribs 46 protruding downward. Lower ends of the ribs 46 define a part of an outline of the conveyer path.

The tray 211 includes side guides 471, 472, which are movable in a direction of sheet-width. The direction of sheet-width is orthogonal to the conveying direction to convey the sheet and may be the front-rear direction (see FIG. 3A) in the present embodiment. The side guides 471, 472 are movable in conjunction with one another so that, when one of the side guides 471, 472 is moved in one direction along the front-rear direction, the other one of the sheet guides 471, 472 is moved in the opposite direction along the front-rear direction. Thereby, a distance between the side guides 471, 472 may be adjusted while a center between the side guides 471, 472 stays aligned at a center of the conveyer path.

On one crosswise end, e.g., a rightward end, of the holder 41, disposed is a guide 48. The guide 48 is swingably attached to the holder 41. The holder 41 is swingable about the rotation shaft 43 to move to a position thereof according to a thickness of the sheets when the sheets are drawn to a gap between the pickup roller 25 and the supply unit 21 (more specifically, the chute 212), which supports the sheets. In particular, as shown in FIGS. 4A-4D, the holder 41 is movable between a lowermost position (see FIG. 4A), in which the gap between the pickup roller 25 and the supply unit 21 is reduced to a smallest amount, and an uppermost position (see FIG. 4D), in which the gap is enlarged to a largest amount.

The guide 48 includes a guide surface 481, which is arranged in an upper position with respect to the chute 212 and at a position upstream from the holder 41 in the conveying direction, e.g., on a rightward position with respect to the holder 41. When the sheets are set in the supply unit 21, the guide 48 guides leading ends of the sheets to the gap between the pickup roller 25 and the chute 212 along the guide surface 481.

When the holder 41 swings, the guide 48 swings depending on a position of the holder 41, and a relative position of the guide 48 with respect to the holder 41 shifts between a first position (see FIGS. 4A, 4B) and a second position (see FIG. 4D). In a position between the holder 41 and the guide 48, disposed is an urging member 51, e.g., a tension spring. As shown in FIG. 5, the holder 41 includes a first hook 412, and the guide 48 includes a second hook 482, and the urging member 51 is coupled to the first hook 412 at one end and to the second hook 482 at the other end to be stretched between the first hook 412 and the second hook 482. The first position is a position, where a joint, e.g., the second hook 482, between the urging member 51 and the guide 48 is closest to the rotation shaft, 43 of the holder 41 within the conveyer 20. The second position is a position, where the joint between the urging member 51 and the guide 48 is farthest from the rotation shaft 43 of the holder 41 within the conveyer 20.

As seen in the positions of the first hook 412 and the second hook 482, the urging member 51 is disposed at a position closer to one end of the guide 48 along a widthwise direction, e.g., the front-rear direction, than to a widthwise center of the guide 48. In other words, the urging member 51 is located at a frontward position with respect to the widthwise center of the guide 48. Meanwhile, the driving force transmission 45 is arranged at position closer to the widthwise opposite end of the guide 48 from the urging member 51 in the widthwise direction. In other words, the driving force transmission 45 is located at a rearward position in the guide 48.

The holder 41 tends to be urged by own weight of the holder 41 and weights of other parts attached to the holder 41 due to the effect of gravity in a rotating direction, e.g., clockwise FIG. 4A, about the rotation shaft 43. Therefore, when no sheet is set in the supply unit 21, as shown in FIG. 4A, the holder 41 is maintained by the weights at the lowermost position.

While the holder 41 is at the lowermost position, the guide 48 is pulled by the urging member 51 to be urged in a counterclockwise direction in FIG. 4A with respect to the holder 41. Therefore, when no sheet is set in the supply unit 21, as shown in FIG. 4A, the guide 48 is maintained at the first position. In other words, the urging member 51 may provide the urging force to shift the relative position of the guide 4 respect to the holder 41 to the first position.

When the sheets are set in the supply unit 21, the holder 41 swings to move the pickup roller 25 to a position corresponding to the thickness of the sheets. According to the present embodiment. FIGS. 4B, 4C, and 4D illustrate positions of the pickup roller 25 corresponding to approximate thicknesses of 5 mm, 10 mm, and 15 mm of the sheets in the supply unit 21, respectively.

When the holder 41 moves to the position shown in FIG. 4B, a contacting part 483 at an upstream end portion of the guide 48 in the conveying direction, e.g., a rightward end in FIG. 4B, contacts a contact section 53 of the cover 23. The contact section 53 is a protrusive strip formed integrally with the cover 23 to protrude from the second surface 232 and extend longitudinally along the crosswise direction (see also FIG. 6). The contact section 53 is formed in a frontward position with respect to a center of the cover 23 in the front-rear direction. Therefore, the contact section 53 is contacted by the contacting part 483 of the guide 48 at a position closer to the position of the urging member 51 than to the widthwise center of the guide 48 in the widthwise direction being the front-rear direction. In other words, the contact section 53 contacts the contacting part 483 of the guide 48 at the frontward position with respect to the widthwise center of the guide 48. The contacting part 483 is a part of the guide 48 at an upstream end in the conveying direction, formed to protrude upward with respect to an upper surface of the guide 48.

While the contacting part 483 contacts the contact section 53 (see FIG. 4B), unless the holder 41 is moved further toward the uppermost position, the guide 48 is maintained at the first position by the urging member 51. When the holder 41 is moved further from the position shown in FIG. 4B toward the uppermost position, as shown in FIG. 4C, the contact section 53 restricts the contacting part 483 from moving along with the holder 41. The contacting part 483 being restricted by the contact section 53 is not allowed to move further upward therefrom.

Meanwhile, however, the guide 48 is allowed to swing with respect to the holder 41 from a position closer to the first position toward a position closer to the second position in the clockwise direction in FIGS. 4B-4C against the urging force from the urging member 51. In other words, the guide 48, in particular, the guide surface 481, is movable to be away from the supply unit 21. Therefore, while the contact section 53 restricts the contacting part 483 from moving upward, the guide 48 allows the holder 41 to swing further toward the uppermost position to a position, for example, shown in FIG. 4C.

When the holder 41 is moved to swing further from the position shown in FIG. 4C toward the uppermost position, the holder 41 may reach the uppermost position shown in FIG. 4D. When the holder 41 reaches the uppermost position, the guide 48 is moved to the second position. Thus, a distance between a downstream end of the guide 48, or the guide surface 481, in the conveying direction and an upper surface of the chute 212 to support the sheets increases as the guide 48 moves to be closer to the second position while the holder 41 is in the uppermost position. In the present embodiment, the uppermost position for the holder 41 is a position, in which the holder 41 should not contact the second surface 232 of the cover 23, and in which a lower end of the pickup roller 25 should be at a substantially same height as the lower ends of the ribs 46. Therefore, while the supply unit 21 may accept a bundle of sheets stacked up to a thickness (height) of approximately 15 mm, if a thickness of the bundle of sheets exceeds 15 mm, the bundle of sheets, of which thickness is greater than 15 mm, may be restricted from being set in the supply unit 21 by the lower ends of the ribs 46. Thus, the holder 41 may be prevented from being uplifted to a position, where the lower end of the pickup roller 25 is higher than the lower ends of the ribs 46, and the holder 41 may be prevented from colliding with the second surface 232 of the cover 23.

The guide 48 is formed to have notches 55 (see FIG. 7) at the upstream end portion thereof, in the conveying direction. The notches 55 are formed in positions to coincide with the ribs 46 formed on the second surface of the cover 23. The ribs 46 may be inserted in the notches 55, and the upstream end portion, e.g., the rightward end (see FIGS. 4A-4D), of the guide 48 in the conveying direction may be in an upper position with respect to the lower ends of the ribs 46 at areas, where the guide 48 adjoins the ribs 46. When the sheets are set in the supply unit 21, the sheets may be drawn downstream in the conveying direction along the lower ends of the ribs 46. In this regard, therefore, the sheets may be prevented from being caught by the upstream end of the guide 48 but may be smoothly set in the supply unit 21.

The holder 41 further includes a support shaft 57 at a position of a swing axis for the guide 48 (see FIGS. 8A and 8B). The support shaft 57 may be formed to protrude outward along the direction of depth, e.g., the front-rear direction, and have a cross-sectional shape, in a view at a plane orthogonal to the front-rear direction, having a larger diameter section 571 and a smaller diameter section 572. The larger diameter section 571 has a shape of a part of a circle, and the smaller diameter section 572 has a diameter smaller than the diameter of the larger diameter section 571. Meanwhile, the guide 48 is formed to have a bearing 58, in which the support shaft 57 may be rotatably supported, and a lead path 59, through which the support shaft 57 may be led to the bearing 58. The lead path 59 is formed to have a width which is smaller than the diameter of the larger diameter section 571 and larger than the diameter of the smaller diameter section 572. The width of the lead path 59 refers to a dimension orthogonal to an extending direction of the lead path 59.

When the guide 48 is to be attached to the holder 41, the support shaft 57 is led to the bearing 58 through the lead path 59, with use of the smaller diameter of the smaller diameter section 572 aligning in parallel with the lead path 59. When the support shaft 57 reaches the hearing 58, a relative position of the guide 48 with respect to the holder 41 is initially at a third position (indicated by broken lines in FIG. 8A), which is in an opposite position from the second position (see FIG. 8B) across the first position (indicated by solid lines in FIG. 8A). As the guide 48 is moved to swing from the third position to the position between the first position and the second position, the guide 48 is placed in an attached condition with the holder 41. Once the guide 48 is attached to the holder 41, even when the relative position of the guide 48 with respect to the holder 41 changes, the larger diameter of the larger diameter section 571 may restrict the support shaft 57 from reentering the lead path 59. Therefore, the support shaft 57 may be prevented from being separated from the bearing 58.

The holder 41 further includes a resilient stopper 61 (see FIGS. 9A, 9B). The resilient stopper 61 is formed integrally with the holder 41 in an upper position with respect to the pickup roller 25 and on a side, e.g., a right side in FIGS. 9A and 9B, of the separator roller 26A, when the holder 41 is in the lowermost position. The resilient stopper 61 is extended continuously to the holder 41 at a leftward end in FIGS. 9A, 9B, and a part extending rightward therefrom is resiliently deformable. Meanwhile, the guide 48 is formed to have a projection 63 integrally. The projection 63 is formed to protrude toward the resilient stopper 61. The projection 63 and the resilient stopper 61 are arranged in such positions that the projection 63 and the rightward end of the resilient stopper 61 overlap each other when the guide 48 is being attached to the holder 41.

When the guide 48 is moved from the third position, which is indicated by broken lines in FIG. 9A, to the position between the first position, indicated by solid lines in FIG. 9A, and the second position, shown in FIG. 9B, the resilient stopper 61 contacting the projection 63 is resiliently deformed and moved over the projection 63. Once the guide 48 is attached to the holder 41, the resilient stopper 61 collides with the projection 63 when the guide 48 is moved to the first position. Thereby, the guide 48 may be restricted from moving toward the third position beyond the first position.

The guide 48 further includes a swing stopper 65 (see FIGS. 10A, 10B), which is formed integrally. The swing stopper 65 is, as shown in FIG. 7, formed in a frontward position in the guide 48 with respect to the projection 63. The swing stopper 65 is extended continuously to the guide 48 at an upper-rightward end in FIGS. 10A, 10B and has a part extending lower-leftward therefrom. When the guide 48 is moved to swing toward the third position beyond the first position the swing stopper 65 collides with a rotatable member 67, which may be a shaft to rotate along with the pickup roller 25. Thereby, the guide 48 may be restricted from moving toward the third position beyond the first position even more securely.

Thus, according to the present embodiment, the swing movement of the guide 48 may be restricted by the resilient stopper 61 firstly, but when a larger amount of load which may not he borne by the resilient stopper 61 alone is applied to the resilient stopper 61, secondly, the load may be absorbed by the swing stopper 65. Thereby, the rotatable member 67 may be prevented from being subject to the larger amount of load. Meanwhile, even when the swing movement cannot be restricted by the resilient member 61 alone, the swing movement of the guide 48 may still be restricted by the swing stopper 65 so that the guide 48 may be prevented from being detached from the holder 41.

Advantageous Effects

As has been described above, by the MFP 1 according to the embodiment, the guide 48 may guide the sheets in the supply unit 21 to the gap between the pickup roller 25 and the supply unit 21 along the guide surface 481, which is arranged in the position upstream from the holder 41 in the conveying direction. Therefore, the supply unit 21 may start guiding the sheets earlier at a position upstream compared to a supply unit, which may guide the sheets by the holder 41 alone, so that the sheets may be guided to the gap between the pickup roller 25 and the supply unit 21 more smoothly, According to the MFP 1 described above, when the holder 41 is moved to swing from a lower position to a higher position, a relative position of the guide 48 with respect to the holder 41 is shifted from a position closer to the first position to a position closer to the second position. In this regard, the guide surface 481 is moved away from the supply unit 21. Therefore, compared to a configuration, in which a part corresponding to the guide 48 is relatively immovable with respect to the holder 41, the movable range for the guide 48 may be prevented from being enlarged. Accordingly, a volume of the neighboring area around the holder 41 and the guide 48 may be reduced, and dimensions of the MFP 1, including height, may be reduced.

Further, by the urging member 51 in the holder 41, the pressure to be applied to the sheets through the pickup roller 25 increases as the number of sheets to be drawn to the gap between the pickup roller 25 and the supply unit 21 increases. Therefore, when a larger number of sheets are drawn to the gap, a greater amount of pressure may be applied to the sheets so that even the curled sheets may be correctly fed, and idle rotation of the pickup roller 25 may be prevented. Meanwhile, when a smaller number of sheets are drawn to the gap, the pressure to the sheets may be lessened so that the load to the sheets may be reduced, and the sheets may be prevented from being wrinkled.

According to the MFP 1 described above, the end portion of the guide 48 on the upstream in the conveying direction is located, at the upper position than the lower ends of the rib 46, at the areas where the upstream end portion of the guide 48 and the ribs 46 adjoin each other. Therefore, the sheets are guided along the lower ends of the ribs 46 and drawn to the lower position with respect to the upstream end portion of the guide 48. Thus, the sheets may be prevented from floating upward to be higher than the upstream end portion of the guide 48.

According to the MFP 1 described above, the cover 23 provides the contact section 53. Therefore, compared to a configuration, in which the contact section 53 is provided separately from the cover 23, a quantity of items in the MFP 1 may be reduced. Further, a number of manufacturing processes may be reduced, and a weight of the MFP 1 may be reduced.

According to the MFP 1 described above, when the holder 41 swings to the uppermost position, the holder 41 may be restrained from colliding with the second surface 232 of the cover 23. Therefore, the holder 41 and the cover 23 may be prevented from being damaged by each other. Further, noises that may otherwise be caused by the collision may be restrained.

According to the MFP 1 described above, while the axially extending direction of the swing axis for the guide 48 may be referred to as the widthwise direction of the guide 48, the urging member 51 may be arranged in the position closer to the widthwise end than to the widthwise center of the guide 48. Therefore, the pickup roller 25, which is at the approximately widthwise center, may be prevented from being interfered with by the urging member 51.

According to the MFP 1 described above, the contact section 53 may be arranged to contact the contacting part 483 of the guide 48 at the position closer to the urging member 51 than to the widthwise center of the guide 48. Thus, the area, in which the urging force from the urging member 51 acts on the guide 48, and the area, in which the force from the contact section 53 acts on the guide 48, are arranged in proximity to each other. Therefore, the guide 48 may be restrained from being twisted by the different forces.

According to the MFP 1 described above, the driving force transmission 45 is arranged on the opposite side from the urging member 51 within the holder 41 therefore, the driving force transmission 45 may be prevented from being interfered with by the urging member 51.

According to the MFP 1 described above, the holder 41 may have the support shaft 57 protruding outward, about which the holder 41 is swingable. The cross-sectional shape of the support shaft 57 viewed along the protruding direction may include the larger diameter section 571, having an outline of a part of a circle, or an arc, and the smaller diameter section 572, having a diameter smaller than the diameter of the larger diameter section 571. Meanwhile, the guide 48 may have the bearing 58, by which the support shaft 57 may be rotatably supported, and the lead path 59, through which the support shaft 57 may be led to the bearing 58. The lead path 59 may be formed to have a width which is smaller than the diameter of the larger diameter section 571 and larger than the diameter of the smaller diameter section 572. When the guide 48 is attached to the holder 41, the support shaft 57 may be led to the bearing 58 through the lead path 59 with the smaller diameter section 572 aligned in parallel with the lead path 59. When the support shaft 57 reaches the bearing 58, the relative position of the guide 48 with respect to the holder 41 may be at the third position, which is in the opposite position from the second position across the first position. As the guide 48 is moved from the third position to a position between the first position and the second position, the guide 48 may be attached to the holder 41. Once the guide 48 is attached to the holder 41, even when the relative position of the guide 48 with respect to the holder 41 is changed, the larger diameter section 71 may restrict the support shaft 57 from reentering the lead path 59. Thus, the lead path 59 may prevent the support shaft 57 from being separated from the bearing 58.

According to the MFP 1 described above, the resilient stopper 61 may restrict the guide 48 from moving beyond the first position toward the third position. When the guide 48 is moved from the third position to the position between the first position and the second position, the resilient stopper 61 contacting the projection 63 may be resiliently deformed and moved over the projection 63. Once the guide 48 is attached to the holder 41, the resilient stopper 61 may collide with the projection 63 when the guide 48 is moved to the first position. Thereby, the guide 48 may be restricted from moving toward the third position beyond the first position. Thus, the guide 48 may be prevented from being detached from the holder 41.

According to the MFP 1 described above, further, the guide 48 may include the swing stopper 65, which may contact the pickup roller 25 or the rotatable member rotating along with the pickup roller 25 when the guide 48 is moved beyond the first position toward the third position and restrict guide 48 from moving further toward the third position. When the guide 48 is moved to swing beyond the first position toward the third position, the swing stopper 65 may collide with the rotatable member; therefore, the guide 48 may be restricted from moving toward the third position beyond the first position even more securely. If the guide 48 is equipped with both the resilient stopper 61 and the swing stopper 65, the swing movement of the guide 48 may be restricted by the resilient stopper 61 primarily, but when a larger amount of load which may not be borne by the resilient stopper 61 alone is applied to the resilient stopper 61, later, the load may be restricted by the swing stopper 65. Thereby, the pickup roller 25 and/or the rotatable member 67 which rotates along with the pickup roller 25 may be prevented from being subject to the larger amount of load. Meanwhile, even when the swing movement cannot be restricted by the resilient member 61 alone, the swing movement of the guide 48 may still be restricted by the swing stopper 65 so that the guide 48 may be prevented from being detached from the holder 41.

More Examples

Although an example of carrying out the disclosure have been described, those skilled in the art will appreciate that there are numerous variations and permutations of the sheet conveyer and an image reading apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the reader unit 3 and the ADF unit 6 may not necessarily incorporated in the MFP 1 to provide one of the multiple functions may form a single-functional scanning apparatus to provide the single function.

What is claimed is:

1. A sheet conveyer, comprising:

a sheet support configured to support a sheet;

a pickup roller configured to convey the sheet supported by the sheet support downstream in a conveying direction;

a separator roller configured to separate the sheet conveyed by the pickup roller to convey one by one further downstream in the conveying direction;

a holder configured to support the pickup roller rotatably, the holder being configured to be swingable about an axis extending in parallel with a rotation axis of the pickup roller to move between a lowermost position, in which a gap between the pickup roller and the sheet support is smallest, and an uppermost position, in which the gap is largest;

a guide configured to be attached to the holder and movable to swing relatively to the holder about a swing axis in accordance with a swing movement of the holder between a first position and a second position with respect to the holder, the guide comprising a guide surface arranged on an upstream side of the holder in to the conveying direction, the guide being configured guide a leading end of the sheet set on the sheet support to the gap between the pickup roller and the sheet support along the guide surface;

an urging member arranged between the holder and the guide, the urging member being configured to apply urging force that acts on the guide to move toward the first position with respect to the holder; and a contact section configured to contact a contacting part in the guide, when the holder swings to move from a position closer to the lowermost position toward a position closer to the uppermost position, and restrict the contacting part from being moved along with the swing movement of the holder, wherein, when the holder swingably moved toward the uppermost position is at a position where the contact section restricts the contacting part from moving, the guide is movable relatively to the holder from a position closer to the first position toward a position closer to the second position against the urging force from the urging member and allows the holder to further move toward the uppermost position.

2. The sheet conveyer according to claim 1, wherein the urging member comprises a tension spring, the tension spring being coupled to e holder at one end and to the guide at the other end and configured to be stretched between the holder and the guide when the guide is moved relatively to the holder from the position closer to the first position to the position closer to the second position.

3. The sheet conveyer according to claim 1, further comprising:

a cover arranged in an upper position with respect to the holder and the guide, the cover comprising a first surface being a part of an exterior covering of the sheet conveyer and a second surface formed to have a rib protruding downward, a lower end of the rib defining a part of an outline of a conveyer path for the sheet;

wherein an end portion of the guide is located in an upper position with respect to a lower end of the rib at an area where the guide adjoins the rib.

4. The sheet conveyer according to claim 3, wherein the contact section is arranged on the cover.

5. The sheet conveyer according to claim 3, wherein the holder is restrained from contacting the second surface of the cover even when the holder is in the uppermost position.

6. The sheet conveyer according to claim 1, wherein the urging member is arranged in a position closer to a widthwise end of the guide than to a widthwise center of the guide with regard to a widthwise direction, which is an axially extending direction of the swing axis for the guide.

7. The sheet conveyer according to claim 6, wherein the contact section is arranged to contact the contacting part of the guide at a position closer to the urging member than to the widthwise center of the guide with regard to the widthwise direction.

8. The sheet conveyer according to claim 6, wherein the holder is swingably attached to a rotation shaft, the rotation shaft being driven by a driving force to rotate;

wherein a driving force transmission to transmit driving force from the rotation shaft to the pickup roller is attached to the holder; and wherein the driving force transmission is arranged at a position closer to a widthwise opposite end from the urging member with regard to the widthwise direction.

9. The sheet conveyer according to claim 1, wherein the holder comprises a support shaft at a position of the swing axis for the guide, the support shaft being formed to protrude outward in a cross-sectional shape, in a view at a plane orthogonal to a protruding direction, comprising a larger diameter section being in a shape of a part of a circle and a smaller diameter section, of which diameter is smaller than a diameter of the larger diameter section;

wherein the guide comprises a bearing, the bearing being configured to rotatably support the support shaft, and a lead path, the lead path being configured to lead the support shaft to the bearing there-through, a width of the lead path being smaller than the diameter of the larger diameter section and larger than the diameter of the smaller diameter section; and wherein, in order to attach the guide to the holder, the support shaft is led through the lead path to the bearing with use of the smaller diameter section and is placed initially in a third position which is opposite from the second position across the first position when the support shaft reaches the bearing; when the guide is moved to swing from the third position to a position between the first position and the second position, the guide is set in an attached condition with the holder; and once the guide is attached to the holder, the support shaft is restricted from reentering the lead path by the larger diameter of the larger diameter section even when a relative position of the guide with respect to the holder changes between the first position and the second position.

10. The sheet conveyer according to claim 9, wherein the holder comprises a resilient stopper configured to resiliently deform and move over a projection formed in the guide when the guide being attached to the holder is moved from the third position to the position between the first position and the second position; and wherein the resilient stopper is configured to contact the projection and restrict the guide from moving from the position between the first position and the second position toward the third position beyond the first position once the guide is attached to the holder.

11. The sheet conveyer according to claim 9, wherein the guide comprises a swing stopper configured to contact one of the pickup roller and a rotatable member being rotatable along with the pickup roller when the guide is moved to swing toward the third position beyond the first position, and restrict the guide from moving further toward the third position.

12. The sheet conveyer according to claim 1, wherein the first position is a position, where a joint between the urging member and the guide is closest to the axis of the holder, and the second position is a position, where the joint is farthest from the axis of the holder.

13. The sheet conveyer according to claim 1, wherein a distance between a downstream end of the guide in the conveying direction and a supporting surface of the sheet increases as the guide moves to be closer to the second position while the holder is in the uppermost position.

14. An image reading apparatus, comprising:

a sheet support configured to support a sheet;

a conveyer configured to pick up the sheet from the sheet support and convey the sheet along a conveyer path in a conveying direction; and a reader unit configured to read images of the sheet being conveyed by the sheet support wherein the conveyer comprises:

a pickup roller configured to convey the sheet supported by the sheet support downstream in the conveying direction;

a separator roller configured to separate the sheet conveyed by the pickup roller to convey one by one further downstream in the conveying direction;

a holder configured to support the pickup roller rotatably, the holder being configured to be swingable about an axis extending in parallel with a rotation axis of the pickup roller to move between a lowermost position, in which a gap between the pickup roller and the sheet support is smallest, and an uppermost position, in which the gap is largest;

a guide configured to be attached to the holder and movable to swing relatively to the holder about a swing axis in accordance with a swing movement of the holder between a first position and a second position with respect to the holder, the guide comprising a guide surface arranged on an upstream side of the holder in the conveying direction, the guide being configured guide a leading end of the sheet set on the sheet support to the gap between the pickup roller and the sheet support along the guide surface;

an urging member arranged between the holder and the guide, the urging member being configured to apply urging force that acts on the guide to move toward the first position with respect to the holder; and a contact section configured to contact a contacting part in the guide, when the holder swings to move from a position closer to the lowermost position toward a position closer to the uppermost position, and restrict the contacting part from being moved along with the swing movement of the holder, wherein, when the holder swingably moved toward the uppermost position is at a position where the contact section restricts the contacting part from moving, the guide is movable relatively to the holder from a position closer to the first position toward a position closer to the second position against the urging force from the urging member and allows the holder to further move toward the uppermost position.

* * * * *